US006639363B2

(12) United States Patent
Amatsuchi et al.

(10) Patent No.: US 6,639,363 B2
(45) Date of Patent: Oct. 28, 2003

(54) PLASMA DISPLAY PANEL

(75) Inventors: Mario Amatsuchi, Yamanashi-ken (JP); Chiharu Koshio, Yamanashi-ken (JP); Kimio Amemiya, Yamanashi-ken (JP)

(73) Assignees: Pioneer Corporation, Tokyo (JP); Pioneer Display Products Corporation, Shizuoka-ken (JP)

( * ) Notice: Subject to any disclaimer, the term of this patent is extended or adjusted under 35 U.S.C. 154(b) by 134 days.

(21) Appl. No.: 09/988,613

(22) Filed: Nov. 20, 2001

(65) Prior Publication Data

US 2002/0063523 A1 May 30, 2002

(30) Foreign Application Priority Data

Nov. 29, 2000 (JP) ..... 2000-363049

(51) Int. Cl.[7] ..... H01J 17/49
(52) U.S. Cl. ..... 313/582
(58) Field of Search ..... 313/581–7; 315/169.4; 345/60, 67

(56) References Cited

U.S. PATENT DOCUMENTS 6,486,611 B2 * 11/2002 Tokunaga et al. ..... 315/169.4
6,492,770 B2 * 12/2002 Amemiya et al. ..... 313/586

FOREIGN PATENT DOCUMENTS

EP 1037249 A1 * 9/2000 ..... H01J/17/49

* cited by examiner

*Primary Examiner*—Sandra O'Shea
*Assistant Examiner*—Sumati Krishnan
(74) *Attorney, Agent, or Firm*—Arent Fox Kintner Plotkin & Kahn

(57) ABSTRACT

A plasma display panel includes a front glass substrate 1 having the back surface on which a plurality of pairs of row electrodes X1, Y1 are formed, a back glass substrate 4 on which column electrodes D are formed, and partition walls 6 made of dielectric materials and defining individual discharge cells C, in which at least either of the row electrodes X1 and Y1 is placed at a position shifted relatively in the column direction toward decreasing the overlapping of the row electrode and the partition wall in reference to the partition wall 6.

5 Claims, 8 Drawing Sheets

V1—V1

V2–V2

V3–V3

V—V

PLASMA DISPLAY PANEL

BACKGROUND OF THE INVENTION

1. Field of the Invention

This invention relates to a panel structure of a surface discharge scheme AC type plasma display panel.

The present application claims priority from Japanese Application No. 2000-363049, the disclosure of which is incorporated herein by reference for all purposes.

2. Description of the Related Art

In recent years, a surface discharge scheme AC type plasma display panel as an oversized and slim display for color screen has received attention, and is becoming widely available.

FIG. 7 is a front view schematically illustrating the cell structure of the surface discharge scheme AC type plasma display panel which has been previously proposed by the present applicant. FIG. 8 is a sectional view taken along the V—V line of FIG. 7.

The PDP illustrated in FIG. 7 and FIG. 8 includes a front glass substrate 1, serving as the display surface, having the back surface on which a plurality of row electrode pairs (X, Y) are arranged in parallel and extend in the row direction of the front glass substrate 1 (the lateral direction of FIG. 7). Each of the pairs of row electrodes X and Y forms one display line (row) L of the matrix display.

The row electrode X is constructed of transparent electrodes Xa each of which is formed of a T-shaped transparent conductive film made of ITO (Indium Tin Oxide) or the like, and a bus electrode Xb formed of a metal film which extends in the row direction of the front glass substrate 1 and is connected to a narrow proximal end of each of the transparent electrodes Xa.

Likewise, the row electrode Y is constructed of transparent electrodes Ya each of which is formed of a T-shaped transparent conductive film made of ITO or the like, and a bus electrode Yb formed of a metal film which extends in the row direction of the front glass substrate 1 and is connected to a narrow proximal end of each of the transparent electrodes Ya.

The row electrodes X and Y are arranged in alternate positions in each display line L in the manner "X-Y" in one display line, "Y-X" in the next display line.

In each of the row electrode pairs (X, Y), each of the transparent electrodes Xa and Ya aligned along the corresponding bus electrodes Xb and Yb extends toward its counterpart in the paired row electrodes such that wide top ends of the paired transparent electrodes Xa, Ya face each other with a discharge gap g of a required width in between.

Each of the bus electrodes Xb and Yb has a double-layer structure with a black conductive layer on the display surface side.

On the back surface of the front glass substrate 1, a black light absorption layer BS extends in the row direction between the back-to-back bus electrodes Xb of the respective row electrode pairs (X, Y) adjacent to each other and between the back-to-back bus electrodes Yb.

A dielectric layer 2 is also formed on the back surface of the front glass substrate 1 and covers the row electrode pairs (X, Y). Furthermore, an additional dielectric layer 2A extends in the row direction and protrudes from the back face of the dielectric layer 2 at a position on the back face of the dielectric layer 2 opposite to the back-to-back bus electrodes Xb (back-to-back bus electrodes Yb) in adjoining pairs and opposite to a region between the back-to-back bus electrodes Xb (back-to-back bus electrodes Yb).

In turn, a protective layer 3 made of MgO is formed on the back faces of the dielectric layer 2 and additional dielectric layers 2A.

The front glass substrate 1 is disposed in parallel to a back glass substrate 4 having a surface facing toward the display surface on which column electrodes D are arranged parallel to each other at predetermined intervals and each extend in a direction at right angles to the row electrode pair (X, Y) (the column direction) in a position opposite to the paired transparent electrodes Xa and Ya in each of the row electrode pairs (X, Y).

On the surface of the back glass substrate 4 on the display surface side, a white dielectric layer 5 covers the column electrodes D, and partition walls 6 are formed on the dielectric layer 5.

The partition wall 6 is shaped in a ladder pattern with vertical walls 6A each of which extends in the column direction in a position between the two parallel arranged column electrodes D, and transverse walls 6B each of which extends in the row direction in a position opposite to the additional dielectric layer 2A. The ladder-patterned partition wall 6 is provided for partitioning the discharge space S situated between the front glass substrate 1 and the back glass substrate 4 into areas, each facing the paired transparent electrodes Xa and Ya in each row electrode pair (X, Y), to form quadrangular discharge cells C.

The partition walls 6 partitioning the discharge space S are arranged in the column direction separated from each other by an interstice SL which extends in the row direction between the two partition walls 6, that is, the interstice SL intervening between the mutually opposite transverse walls 6B of the respective partition walls 6 adjacent to each other. The interstice SL is situated at a position opposing each region between the back-to-back bus electrodes Xb and between the back-to-back bus electrodes Yb.

A phosphor layer 7 is placed on all the five faces made up of the four side faces of the vertical walls 6A and transverse walls 6B of the partition wall 6 and one face of a dielectric layer 5 which face toward the discharge cell C. The phosphor layer 7 formed inside each discharge cell C has a red color (R), a green color (G) or a blue color (B) applied and the phosphor layers 7 are arranged in the order red (R), green (G) and blue (B) along the row direction.

The discharge cell C is filled with a discharge gas.

The protective layer 3 covering the additional dielectric layer 2A is in contact with the face of the transverse walls 6B of the partition walls 6 on the display surface side. Hence, as seen from FIG. 8, the additional dielectric layer 2A provides a block between the adjacent discharge cells C in the column direction.

The PDP as described above displays images through the following procedure.

First, at the concurrent reset period, a reset pulse is applied to the row electrodes X or Y, to cause reset discharge between the column electrode D and the row electrode X or Y in each discharge cell C, which results in forming wall charge on the surface of the dielectric layer 2 in each discharge cell C.

Next, through the line sequential addressing operation in the addressing period, a scan pulse is applied to the row electrode Y to selectively cause opposite discharge (selective discharge) between the transparent electrode Ya and the column electrode D, which results in scattering lighted cells (the discharge cell in which the wall charge on the dielectric layer 2 is not erased) and nonlighted cells (the discharge cell in which the wall charge on the dielectric layer 2 is erased), in all the discharge lines L over the panel in accordance with the image to be displayed.

Then, at the sustain discharge period, a discharge sustain pulse is simultaneously applied alternately to the row electrodes X and Y in all the display lines, to cause surface discharge (sustain discharge) between the transparent electrodes Xa and Ya facing each other in each lighted cell.

The surface discharge in the lighted cell thus generates ultraviolet light. The generated ultraviolet light excites each of the phosphor layers 7 which have the three primary colors, red (R), green (G) and blue (B) applied in the respective discharge cells C, to allow them to emit light for forming a display image.

A feature of the above PDP is that interference may not occur between the discharges in the discharge cells C adjacent to each other in the row direction even when each discharge cell C is reduced in size in order for the screen to increase in definition, because the transparent electrode Xa, Ya of the row electrode X, Y extends from the bus electrode Xb, Yb toward the other row electrode X or Y with which to form a pair so that there are island forms independent of each other in each discharge cell C.

Another feature of the above PDP is the prevention of the occurrence of interference between discharges in the discharge cells C adjacent to each other in the column direction, because the adjacent discharge cells C in the column direction are blocked off from each other as a result of forming the additional dielectric layer 2A on the dielectric layer 2 and allowing the protective layer 3 covering the additional dielectric layer 2A to be in contact with the face of the transverse wall 6B of the partition wall 6 on the display surface side.

However, in the PDP structure as illustrated in FIGS. 7 and 8, the bus electrodes Xb, Yb of the respective row electrodes X, Y are situated in the non-display area on the panel which completely overlays the transverse walls 6B of the partition walls 6 formed of dielectric materials.

Thus, interelectrode capacitance is formed between the bus electrodes Xb or Yb and the column electrode D with the transverse walls 6B interposed, and charge and discharge are produced in relation to the interelectrode capacitance, leading to the disadvantage of a larger amount of reactive power which does not contribute to light emission.

SUMMARY OF THE INVENTION

The present invention has been made to solve the disadvantages associated with the surface discharge scheme AC type plasma display panel as described above.

It is therefore an object of the present invention to provide a plasma display panel capable of a smaller amount of reactive power which does not contribute to light emission.

To attain the above object, a plasma display panel according to a first aspect of the present invention includes: a front substrate; a back substrate facing the front substrate with a discharge space interposed; a plurality of pairs of first and second row electrodes extending in a row direction and arranged in a column direction on the back surface of the front substrate to form display lines; a plurality of column electrodes extending in the column direction and arranged in the row direction on the surface of the back substrate facing toward the front substrate, to form a unit light-emitting area in the discharge space in each intersection with the paired first and second row electrodes; and a partition wall, made of dielectric materials, interposed between the front substrate and the back substrate and defining the individual unit light-emitting areas. A feature of the plasma display panel is that at least either of the paired first and second row electrodes is placed at a position shifted relatively in the column direction toward decreasing the overlapping of the row electrode and the partition wall in reference to the partition wall.

With the plasma display panel of the first aspect, at least either of the first and second row electrodes forming the display line has a portion situated in a no-light-emitting area on the panel. The portion is located at a misaligned position when viewed from the front substrate in reference to the partition wall which is also situated in the no-light-emitting area and defines the individual unit light-emitting areas, which results in a decrease in the area of overlapping of the row electrode and the partition wall.

According to the first aspect, therefore, there is a reduction in interelectrode capacitance formed between the portion of the first or second row electrode situated in the no-light emitting area of the panel and the column electrode with the dielectric-material-made partition wall interposed. The occurrence of charge and discharge in relation to the interelectrode capacitance is thus decreased. This allows a reduction in the amount of reactive power non-contributable to light emission which is associated with the charge and discharge.

To attain the aforementioned object, the feature of a plasma display panel according to a second aspect of the present invention is, in addition to the configuration of the first aspect, that the partition wall includes a plurality of wall parts placed between the front substrate and the back substrate and respectively having vertical walls extending in the column direction and transverse walls extending in row direction to partition the discharge space into the unit light emitting areas in the row direction and column direction; that an interstice extending in parallel to the row direction is formed at a position between the transverse walls of the wall part adjacent to each other in the column direction; and that at least either of the first and second row electrodes has portion extending parallel to the transverse wall of the wall part and being located at a position shifted toward opposing the interstice, situated between the transverse walls, in reference to the transverse wall.

With the plasma display panel of the second aspect, the partition wall partitioning the discharge space between the front substrate and the back substrate into the unit light-emitting areas includes the vertical walls extending in the column direction and the transverse walls extending in the row direction. The transverse walls are separated in the column direction by the interstices parallel to the row direction. At least either of the first and second row electrodes has portion extending in the row direction in the no-light-emitting area on the panel and being located at a position shifted toward opposing the interstice between the transverse walls. This allows a decrease in the area of overlapping of the portion of the row electrode extending in the row direction and the transverse wall when viewed from the front substrate.

According to the second aspect, therefore, there is a reduction in interelectrode capacitance formed between the portion of the first or second row electrode, which is situated in the no-light-emitting area of the panel and extends in the row direction, and the column electrode with the dielectric-material-made partition wall interposed. The occurrence of charge and discharge in relation to the interelectrode capacitance is thus decreased. This allows a reduction in the amount of reactive power non-contributable to light emission which is associated with the charge and discharge.

To attain the aforementioned object, a plasma display panel according to a third aspect of the present invention has the feature, in addition to the configuration of the second aspect, that each of the first and second row electrodes includes an electrode body extending in the row direction, and protruding electrodes each extending from the electrode body toward its counterpart in the paired first and second row electrodes in each unit light emitting area to face the counterpart with a required discharge gap interposed; and the electrode body of at least either of the first and second row electrodes is located at a position shifted toward the interstice situated between the transverse walls in reference to the transverse wall of the wall part.

With the plasma display panel of the third aspect, each of the first and second row electrodes has the protruding electrodes each of which is connected to the electrode body, extending in the row direction, in each unit light-emitting area, to form a so-called island-form discharge portion. The electrode body of the at least either of the first and second electrodes is placed so as to be shifted from the position, opposing the transverse wall of the partition wall extending parallel to the electrode body, toward the interstice between the transverse walls. This configuration decreases area of the overlapping between the electrode body of the row electrode and the transverse wall when viewed from the front substrate.

According to the third aspect, therefore, there is a reduction in interelectrode capacitance formed between the electrode body of the first or second row electrode situated in the no-light-emitting area of the panel and the column electrode with the dielectric-material-made partition wall interposed. The occurrence of charge and discharge in relation to the interelectrode capacitance is thus decreased. This allows a reduction in the amount of reactive power non-contributable to light emission which is associated with the charge and discharge.

To attain the aforementioned object, a plasma display panel according to a fourth aspect of the present invention has the features, in addition to the configuration of the second aspect, that each of the first and second row electrodes includes an electrode body extending in the row direction and protruding electrodes each extending from the electrode body toward its counterpart in the paired first and second row electrodes in each unit light emitting area to face the counterpart with a required discharge gap interposed, and that the first and second row electrodes are arranged in alternate positions in each display line, and at least either of the two first row electrodes and the two second row electrodes which are the same-type row electrodes oriented back to back between two adjacent display lines, have the single electrode body in common, and that the shared electrode body is located at a position opposing the interstice between the transverse walls of the wall part.

With the plasma display panel of the fourth aspect, each of the first and second row electrodes has the protruding electrodes each of which is connected to the electrode body, extending in the row direction, in each unit light emitting area, to form a so-called island-form discharge portion. Further, the first and second row electrodes are alternated in position in each display line in the manner "the first row electrode-the second row electrode" in one display line, "the second row electrode-the first row electrode" in the next display line.

Such an arrangement of the first row electrodes and the second row electrodes allows at least one type of the two adjacent row electrodes coming from two different types of the row electrodes adjacent to each other between adjacent display lines, e.g., two adjacent first row electrodes or two adjacent second row electrodes, to share the use of a single electrode body extending in the row direction. The shared electrode body is placed at a position opposing the interstice between the transverse walls of the wall part of the partition wall. Thus, it is possible to decrease the area of overlapping of the shared electrode body and the transverse walls when view from the front substrate.

According to the fourth aspect, therefore, there is a reduction in interelectrode capacitance formed between the shared electrode body of the first or second row electrodes, situated in the no-light-emitting area of the panel and extending in the row direction, and the column electrode with the dielectric-material-made partition wall interposed. The occurrence of charge and discharge in relation to the interelectrode capacitance is thus decreased. This allows a reduction in the amount of reactive power non-contributable to light emission which is associated with the charge and discharge.

To attain the aforementioned object, a plasma display panel according to a fifth aspect of the present invention has the feature, in addition to the configuration of the fourth aspect, that the shared electrode body has a width equal to or smaller than a width of the interstice between the transverse walls of the partition wall in the column direction.

With the plasma display panel of the fifth aspect, the shared electrode body of the same-type row electrodes adjacent to each other between the adjacent display lines is placed in a position opposing the interstice between the transverse walls of the wall part of the partition wall. Further, the shared electrode body is formed so as to have a width in the column direction equal to or smaller than that of the interstice between the transverse walls in the column direction. This configuration eliminates the overlapping of the shared electrode body and the transverse walls.

According to the fifth aspect, therefore, interelectrode capacitance is not formed between the shared electrode body of the first or second row electrodes and the column electrode with the dielectric-material-made partition wall interposed, and thus charge and discharge in relation to the interelectrode capacitance are not produced. This allows a reduction in the amount of reactive power non-contributable to light emission which occurs if the charge and discharge are produced.

These and other objects and features of the present invention will become more apparent from the following detailed description with reference to the accompanying drawings.

DETAILED DESCRIPTION OF THE PREFERRED EMBODIMENT

The most preferred embodiment according to the present invention will be described hereinafter in detail with reference to the accompanying drawings.

Figure 1:
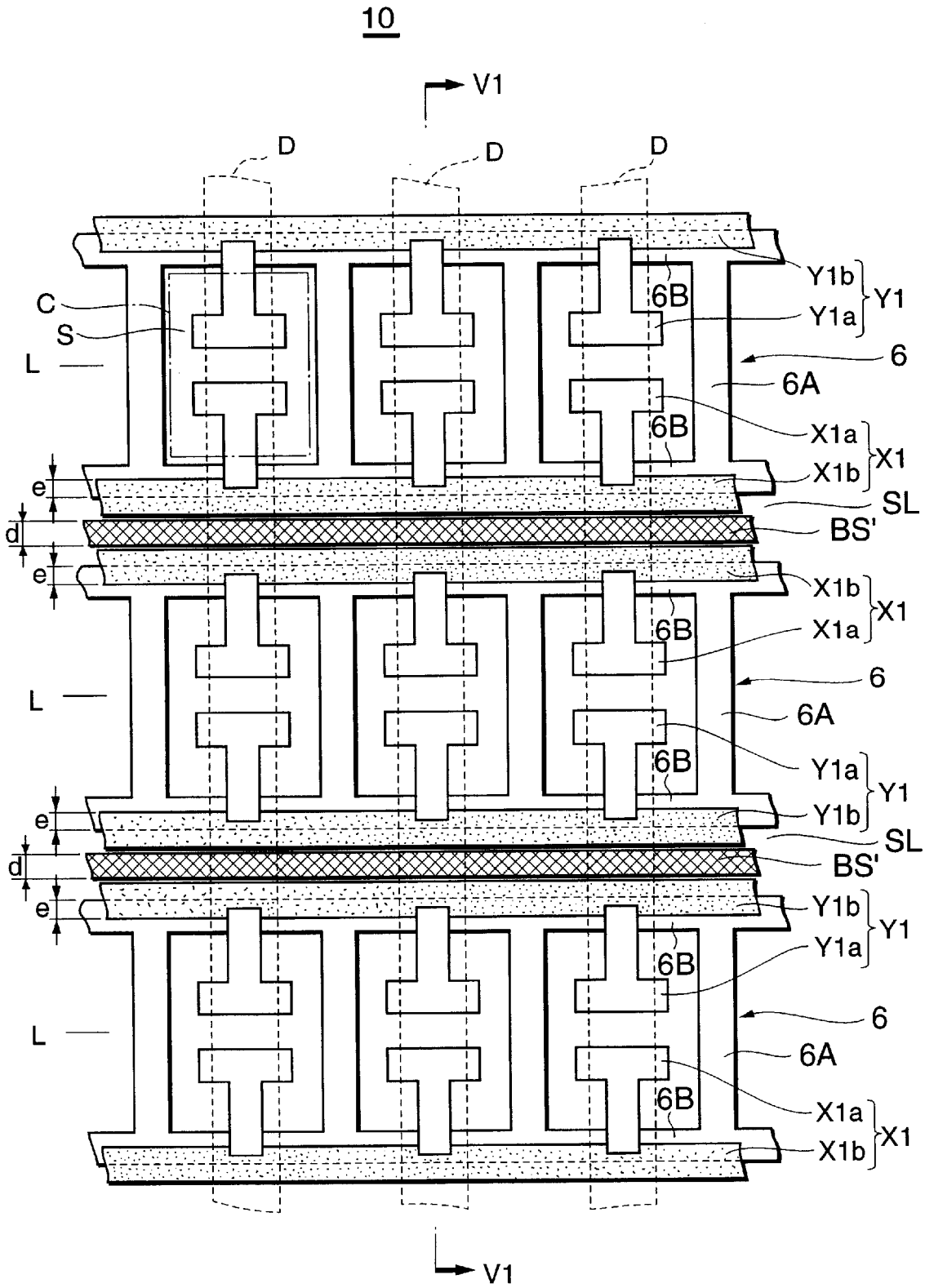
FIG. 1 is a front view schematically illustrating a first example according to the present invention.
Figure 2:
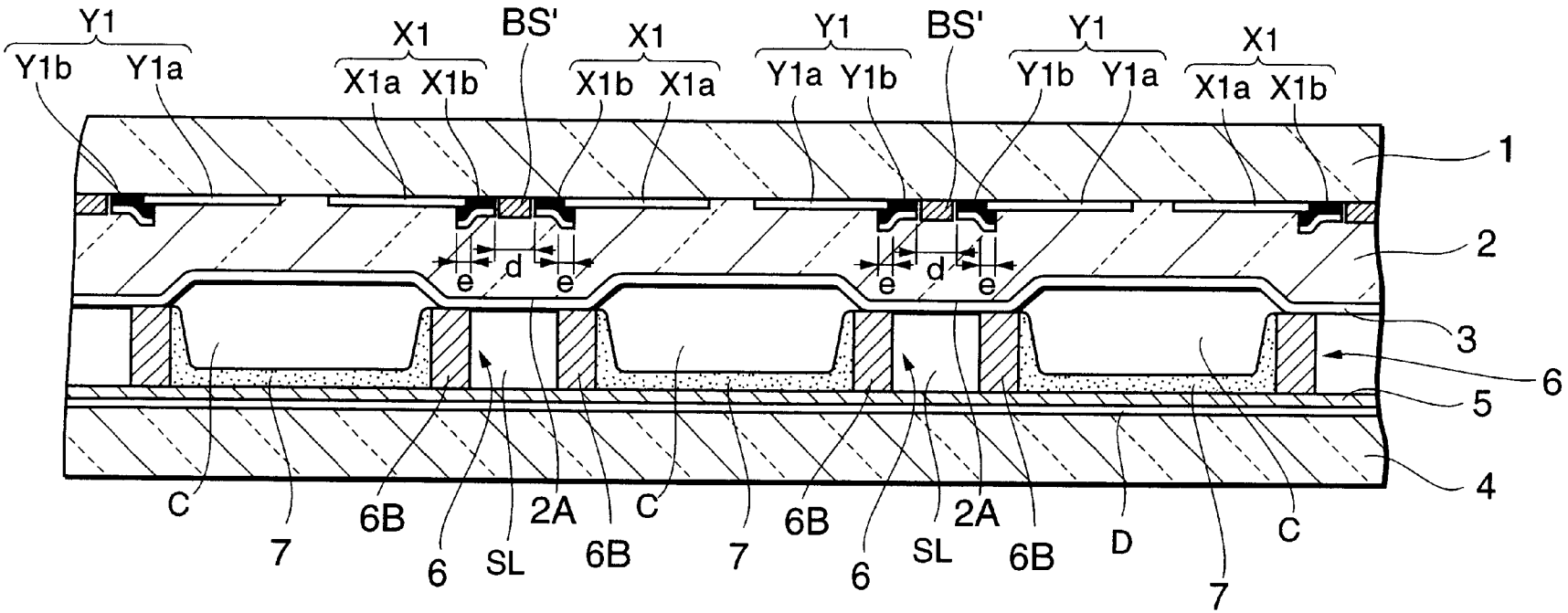
FIG. 2 is a sectional view taken along the V1—V1 line of FIG. 1.

FIGS. 1 and 2 illustrate a first example of the preferred embodiment of a plasma display panel (hereinafter referred to as "PDP") according to the present invention. FIG. 1 is a front view schematically illustrating a PDP 10 in the first example, and FIG. 2 is a sectional view taken along the V1—V1 line of FIG. 1.

The PDP 10 illustrated in FIGS. 1 and 2 has a configuration similar to that of the PDP illustrated in FIGS. 7 and 8, except for a configuration on row electrodes X1, Y1 which will be described later, and components the same as or similar to those in the PDP of FIGS. 7 and 8 have been designated by the same or similar reference numerals and symbols.

Figure 7:
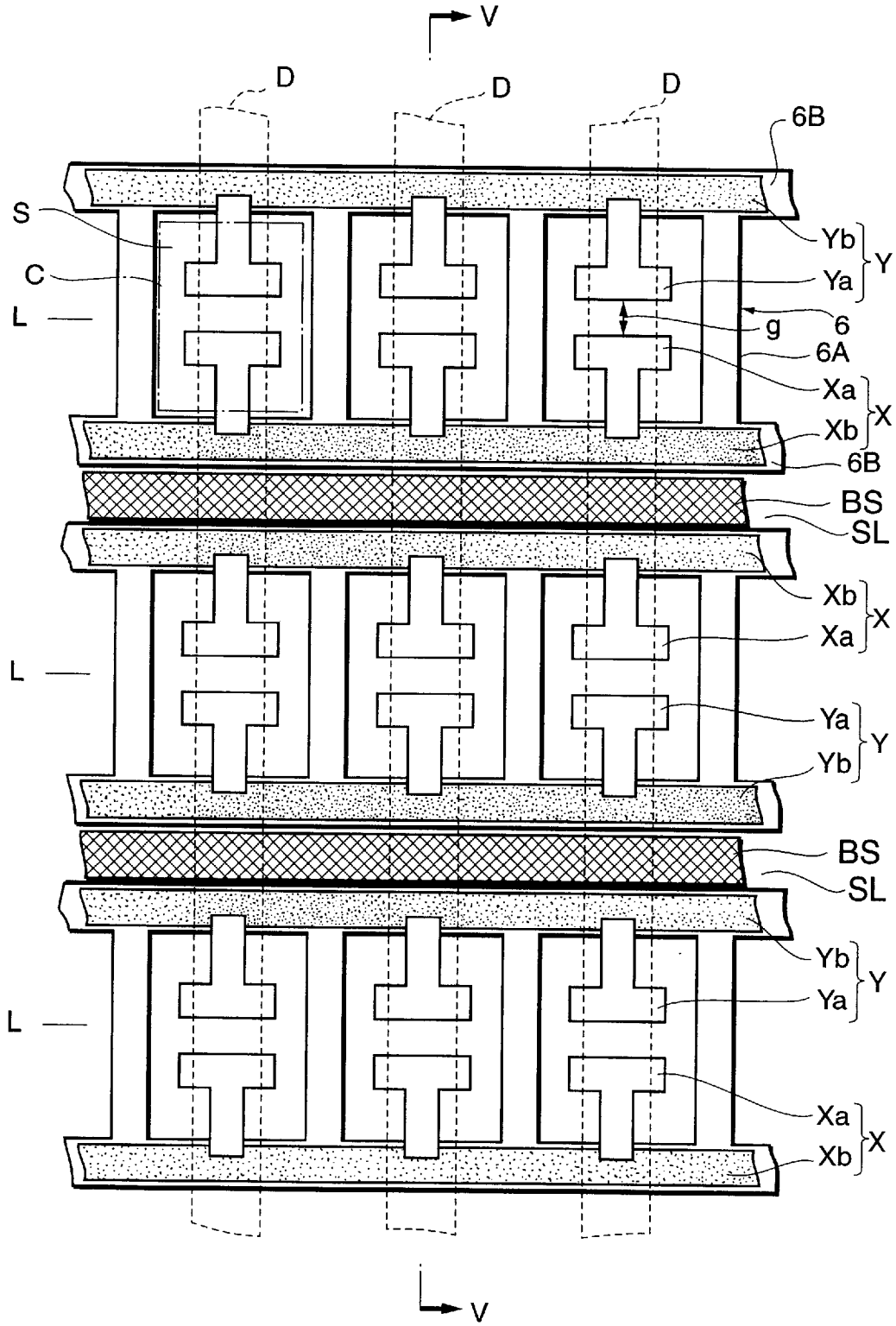
FIG.7 PRIOR ART
FIG. 7 is a front view schematically illustrating a plasma display panel according to a previous proposal.
Figure 8:
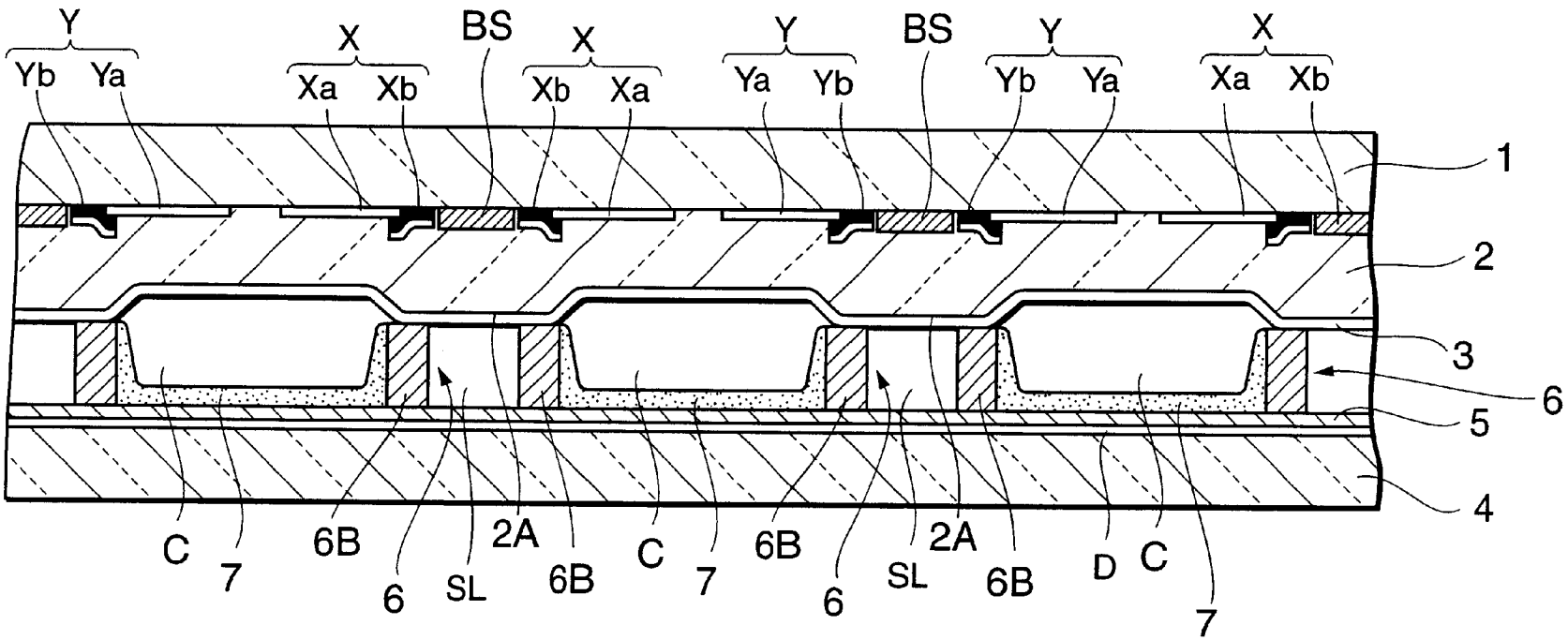
FIG.8 PRIOR ART
FIG. 8 is a sectional view taken along the V—V line of FIG. 7.

As in the case of the PDP of FIGS. 7 and 8, in the PDP 10, row electrodes X1 and Y1 of each row electrode pair (X1, Y1) are arranged in alternate positions in each display line L in the manner "X1-Y1" "Y1-X1".

Each of transparent electrodes X1*a*, Y1*a* of the respective row electrodes X1, Y1 has a relatively larger length than that of the transparent electrode of the PDP illustrated in FIGS. 7 and 8 so as to jut out toward a position opposing the transverse wall 6B of the partition wall 6. In turn, each of the corresponding bus electrodes X1*b* and Y1*b* is placed such that its side facing toward a row electrode pair adjacent thereto juts out toward a position opposing the interstice SL.

For this arrangement, the space d between the opposing row electrodes X1 and X1 or between the opposing row electrodes Y1 and Y1 of the two row electrode pairs (X1, Y1) adjacent to each other, is designed to be smaller than the corresponding space in the PDP illustrated in FIGS. 7 and 8.

As described above, the PDP 10 includes the bus electrodes X1*b*, Y1*b* of the row electrodes X1, Y1 each of which is formed at a position shifted toward the interstice SL in reference to the transverse wall 6B so as to decrease a width e thereof overlapping the transverse wall 6B. This configuration reduces interelectrode capacitance formed between the bus electrode X1*b*, Y1*b* and the column electrode D with the transverse wall 6B, made of dielectric materials, interposed, which results in a reduction in the amount of reactive power associated with charge and discharge produced between the bus electrode X1*b*, Y1*b* and the column electrode D in relation to the interelectrode capacitance.

The foregoing description takes, as an example, the PDP in which the row electrodes X1 and Y1 of each row electrode pair (X1, Y1) are arranged in alternate positions in each display line L.

However, even in a PDP including row electrode pairs constructed with an identical placement of the row electrodes X1 and Y1 such that the row electrodes X1 and Y1 are alternated in the column direction of the panel in the manner "X1-Y1", "X1-Y1", if, as in the first example, each of the bus electrodes X1*b*, Y1*b* of the respective row electrodes X1, Y1 is formed at a position shifted toward the interstice SL in reference to the transverse wall 6B of the partition wall 6, it is possible to reduce the amount of reactive power.

Figure 3:
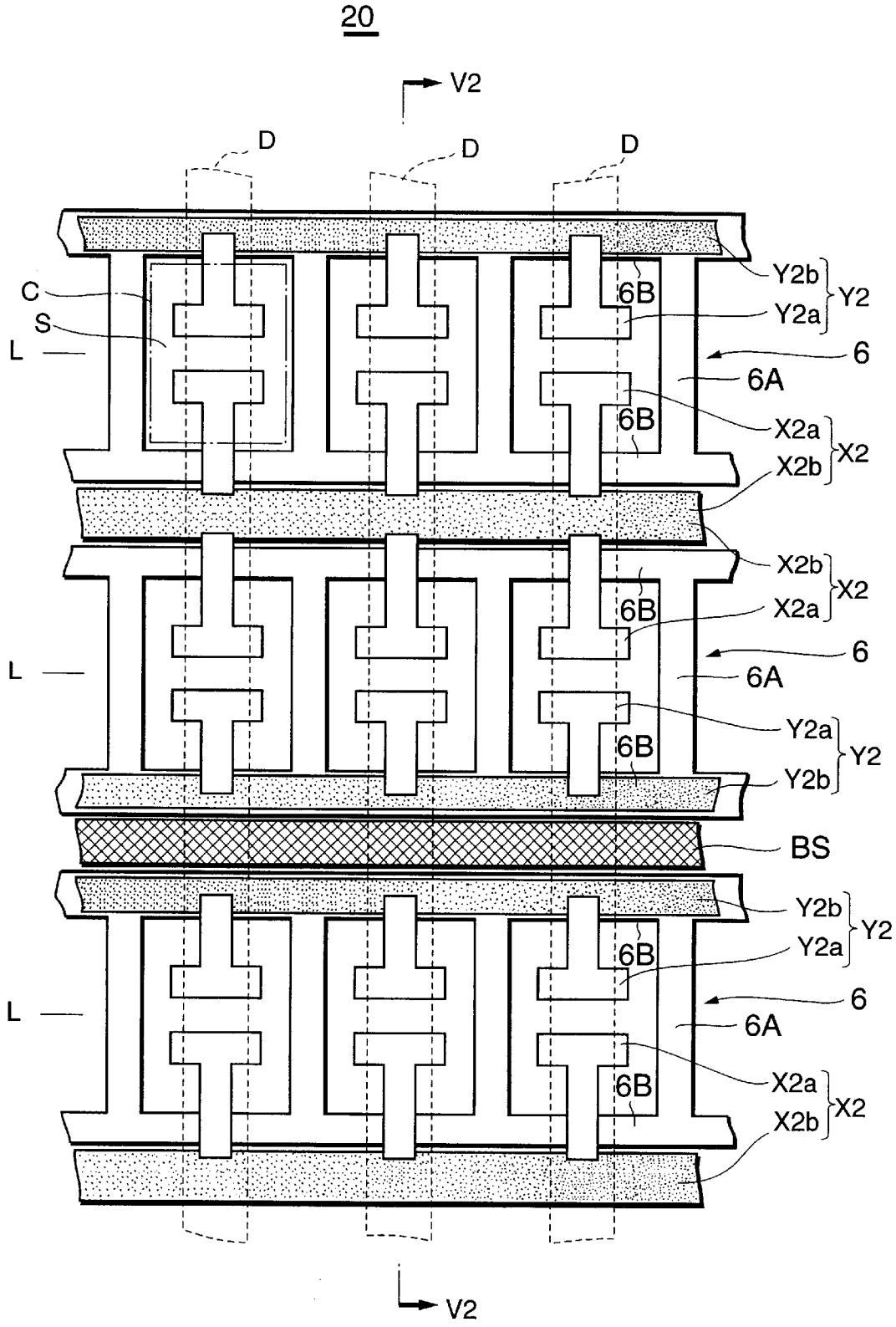
FIG. 3 is a front view schematically illustrating a second example according to the present invention.
Figure 4:
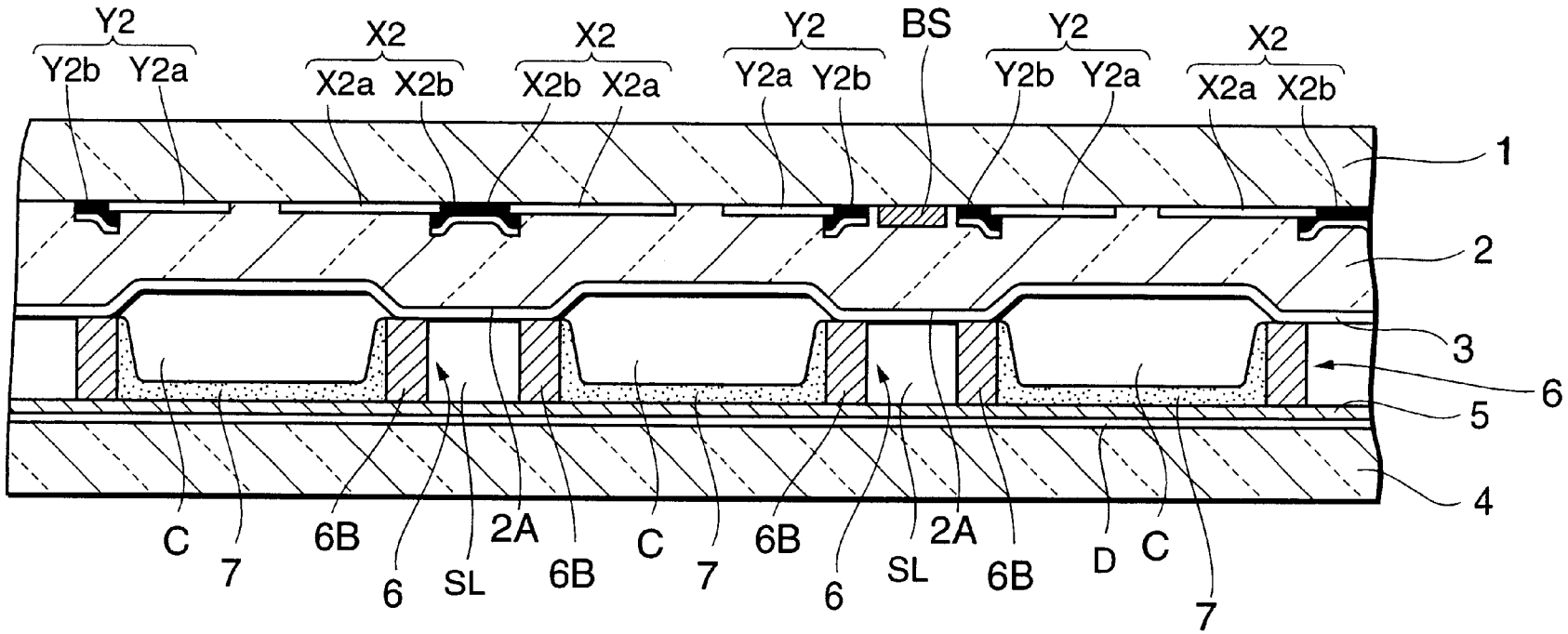
FIG. 4 is a sectional view taken along the V2—V2 line of FIG. 3.

FIG. 3 and FIG. 4 illustrate a second example of the embodiment of the PDP according to the present invention. FIG. 3 is a front view schematically illustrating a PDP 20 in the second example. FIG. 4 is a sectional view taken along the V2—V2 line of FIG. 3.

The PDP 20 illustrated in FIGS. 3 and 4 has a configuration similar to that of the PDP illustrated in FIGS. 7 and 8, except for a configuration on row electrodes X2, Y2 which will be described later, and components the same as or similar to those in the PDP of FIGS. 7 and 8 are designated by the same or similar reference numerals and symbols.

As in the PDP 10 of the first example, the PDP 20 has row electrodes X2 and Y2 of each row electrode pair (X2, Y2) which are arranged in alternate positions in each display line L in the manner "X2-Y2", "Y2-X2".

In one of the row electrodes X2 and Y2 (the row electrode X2 in the second example) to which the scan pulse is not applied in the addressing operation and an equal voltage is applied in each discharge cell, a bus electrode is used in common between the two row electrodes X2 of the respective row electrode pairs adjacent to each other. The single shared bus electrode X2*b* is connected to transparent electrodes X2*a* of the two row electrodes X2 situated on opposite sides of the bus electrode X2*b*.

The bus electrode X2*b* has a width equal to or smaller than that of the interstice SL between the transverse walls 6B of the partition walls 6, and is disposed at the midpoint between the transverse walls 6B, or at a position overlapping the interstice SL.

With such arrangement, the PDP 20 eliminates any area in which the bus electrode X2*b* and the transverse wall 6B of each partition wall 6 overlap each other. This does not allow interelectrode capacitance to be formed between the bus electrode X2*b* and the column electrode D with the dielectric-material-made transverse wall 6B interposed, to eliminate the production of charge and discharge in relation to the interelectrode capacitance, leading to a reduction in the amount of reactive power in the entire PDP.

Figure 5:
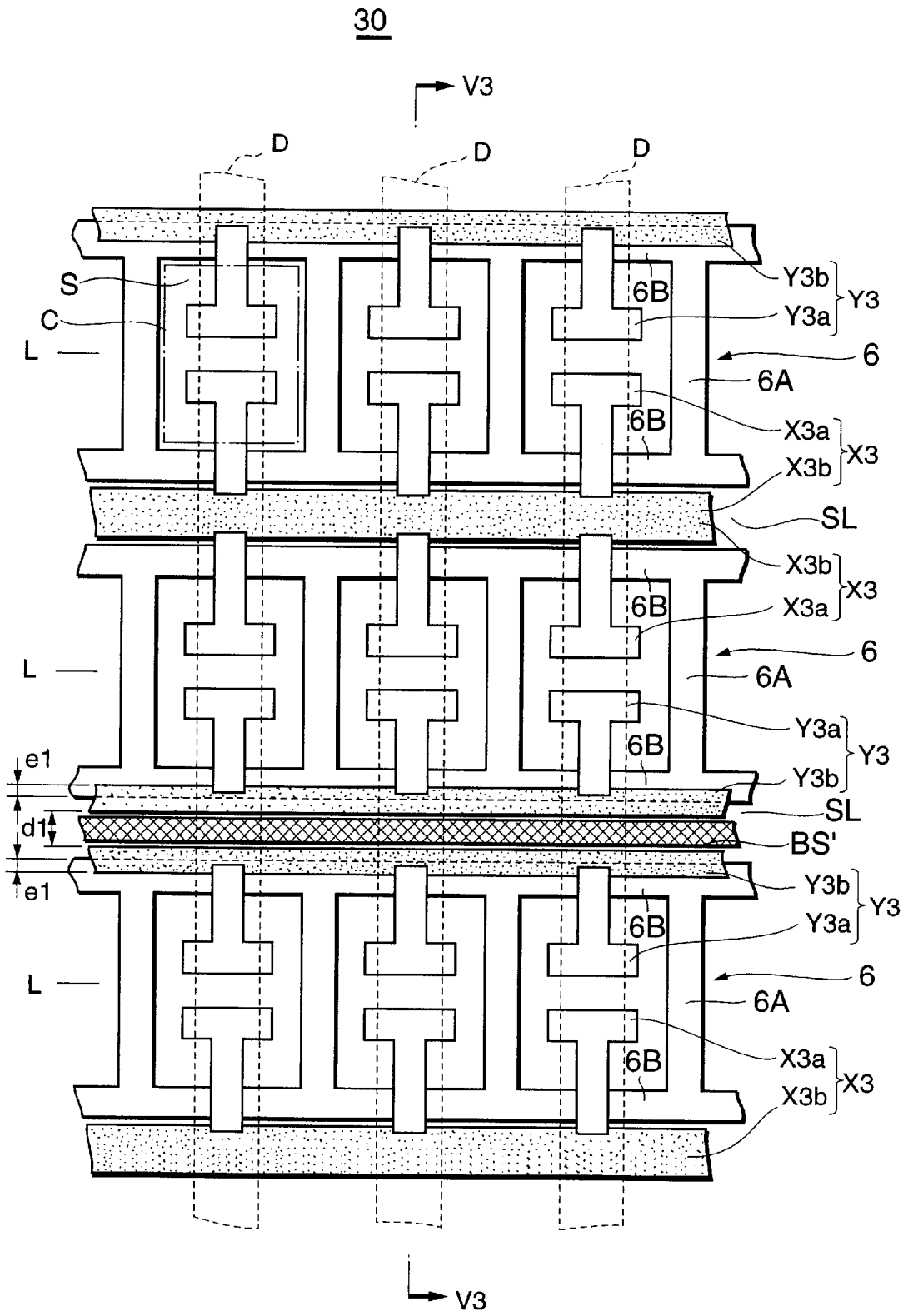
FIG. 5 is a front view schematically illustrating a third example according to the present invention.
Figure 6:
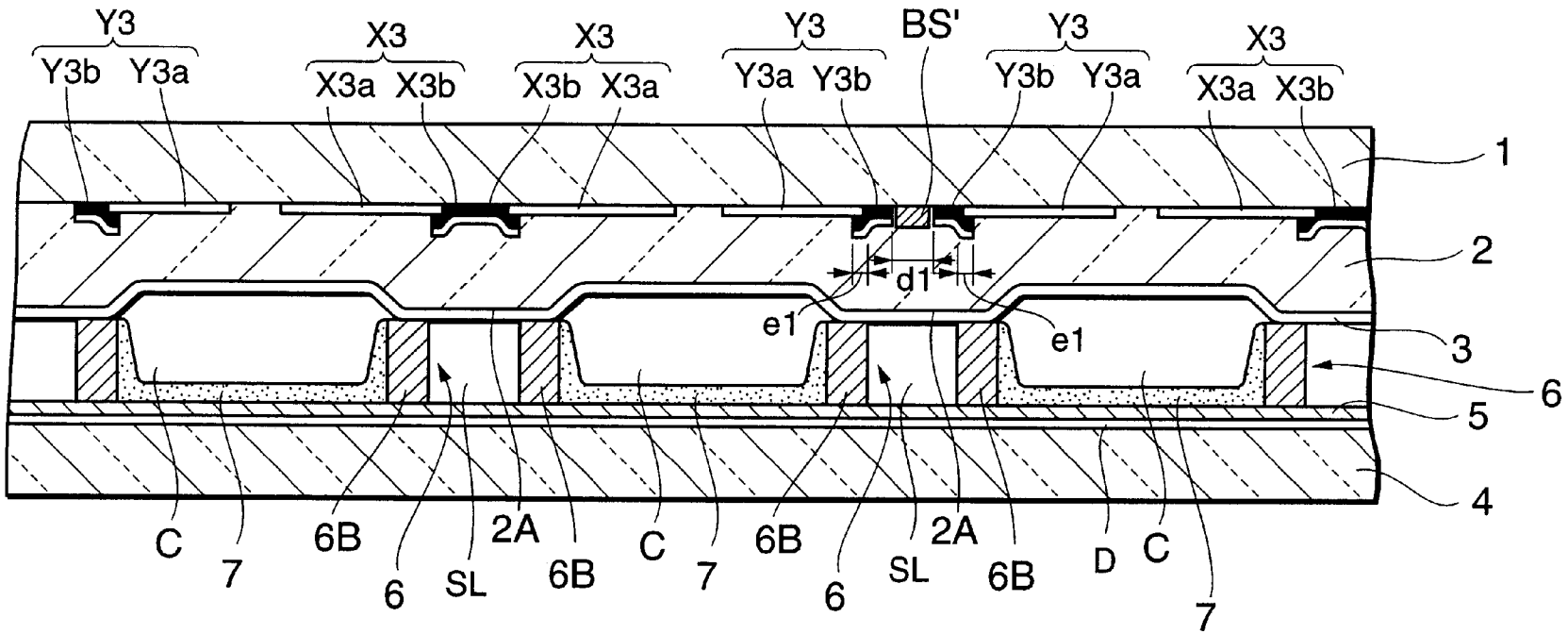
FIG. 6 is a sectional view taken along the V3—V3 line of FIG. 5.

FIG. 5 and FIG. 6 illustrate a third example of the embodiment of the PDP according to the present invention. FIG. 5 is a front view schematically illustrating a PDP 30 in the third example. FIG. 6 is a sectional view taken along the V3—V3 line of FIG. 5.

The PDP 30 illustrated in FIGS. 5 and 6 has a configuration similar to that of the PDP illustrated in FIGS. 7 and 8, except for a configuration on row electrodes X3, Y3 which will be described later, and components the same as or similar to those in the PDP of FIGS. 7 and 8 are designated by the same or similar reference numerals and symbols.

As in the PDP 10 of the first example, the PDP 30 has row electrodes X3 and Y3 of each row electrode pair (X3, Y3) arranged in alternate positions in each display line L in the manner "X3-Y3", "Y3-X3".

As in the case of the aforementioned second example, in one of the row electrodes X3 and Y3 (the row electrode X3 in the third example) to which the scan pulse is not applied in the addressing operation and an equal voltage is applied in each discharge cell, a bus electrode is used in common between the two row electrodes X3 of the respective row electrode pairs adjacent to each other. The single shared bus electrode X3*b* is connected to transparent electrodes X3*a* of the two row electrodes X3 situated on opposite sides of the bus electrode X3*b*.

The bus electrode X3*b* has a width equal to or smaller than that of the interstice SL between the transverse walls 6B of the partition walls 6, and is disposed at the midpoint between the transverse walls 6B, or at a position overlaying the interstice SL.

The other bus electrode Y3*b* is placed such that its side facing toward an adjacent row electrode pair juts out toward a position opposing the interstice SL, as in the case of the first example.

For the above arrangement, a space dl between the opposing row electrodes Y3 and Y3 of the respective row electrode pairs adjacent to each other, is set so as to be smaller than the corresponding space in the PDP illustrated in FIGS. 7 and 8.

The PDP 30 eliminates any area in which the bus electrode X3*b* and the transverse wall 6B of each partition wall 6 overlap each other. Hence, interelectrode capacitance is not formed between the bus electrode X3*b* and the column electrode D with the dielectric-material-made transverse wall 6B interposed.

Further, the bus electrode Y3*b* of the row electrode Y3 is formed at a position shifted toward the interstice SL in reference to the transverse wall 6B so as to decrease a width e1 thereof overlapping the transverse wall 6B. This decreases interelectrode capacitance formed between the bus electrode Y3*b* and the column electrode D with the transverse wall 6B interposed.

This results in a reduction in the amount of reactive power associated with charge and discharge in relation to the interelectrode capacitance which is formed between each of the bus electrodes X3*b*, Y3*b* and the column electrode D with the transverse wall 6B interposed.

The terms and description used herein are set forth by way of illustration only and are not meant as limitations. Those skilled in the art will recognize that numerous variations are possible within the spirit and scope of the invention as defined in the following claims.

What is claimed is:

1. A plasma display panel, comprising:

a front substrate;

a back substrate facing the front substrate with a discharge space interposed;

a plurality of pairs of first and second row electrodes extending in a row direction and arranged in a column direction on the back surface of said front substrate to form display lines;

a plurality of column electrodes extending in the column direction and arranged in the row direction on the surface of said back substrate facing toward said front substrate, to form a unit light-emitting area in the discharge space at each intersection with said paired first and second row electrodes; and a partition wall, made of dielectric materials, interposed between said front substrate and said back substrate and defining the individual unit light emitting areas, wherein at least either of said paired first and second row electrodes is placed at a position shifted relatively in the column direction toward decreasing the overlapping of the row electrode and said partition wall in reference to the partition wall.

2. A plasma display panel according to claim 1, wherein said partition wall includes a plurality of wall parts placed between said front substrate and said back substrate and respectively having vertical walls extending in the column direction and transverse walls extending in the row direction to partition the discharge space into the unit light-emitting areas in the row direction and column direction, wherein an interstice extending parallel to the row direction is formed at a position between said transverse walls of said wall part adjacent to each other in the column direction, and wherein at least either of said first and second row electrodes has portion extending parallel to said transverse wall of said wall part and being located at a position shifted toward opposing the interstice, situated between the transverse walls, in reference to the transverse wall.

3. A plasma display panel according to claim 2, wherein each of said first and second row electrodes includes an electrode body extending in the row direction and protruding electrodes each extending from the electrode body toward its counterpart in the paired first and second row electrodes in each unit light-emitting area to face the counterpart with a required discharge gap interposed, and wherein said electrode body of at least either of said first and second row electrodes is located at a position shifted toward the interstice situated between the transverse walls in reference to the transverse wall of the wall part.

4. A plasma display panel according to claim 2, wherein each of said first and second row electrodes includes an electrode body extending in the row direction and protruding electrodes each extending from the electrode body toward its counterpart in the paired first and second row electrodes in each unit light emitting area to face the counterpart with a required discharge gap interposed, wherein said first and second row electrodes are arranged in alternate positions in each display line, and at least either of said two first row electrodes and said second row electrodes which are the same type row electrodes oriented back to back between two adjacent display lines, have the single electrode body in common, and wherein said shared electrode body is located at a position opposing the interstice between the transverse walls of the wall part.

5. A plasma display panel according to claim 4, wherein said shared electrode body has a width equal to or smaller than a width of the interstice between the transverse walls of the wall part in the column direction.

* * * * *